US008147218B2

(12) United States Patent
Thrasher et al.

(10) Patent No.: US 8,147,218 B2
(45) Date of Patent: Apr. 3, 2012

(54) PNEUMATIC MOTORIZED MULTI-PUMP SYSTEM

(75) Inventors: William B. Thrasher, Seabrook, TX (US); Mark V. Patton, Tulsa, OK (US)

(73) Assignee: Patton Enterprises, Inc., Tulsa, OK (US)

( * ) Notice: Subject to any disclaimer, the term of this patent is extended or adjusted under 35 U.S.C. 154(b) by 524 days.

(21) Appl. No.: 12/492,338

(22) Filed: Jun. 26, 2009

(65) Prior Publication Data

US 2010/0329902 A1 Dec. 30, 2010

(51) Int. Cl.
*F04B 17/00* (2006.01)
*F04B 35/00* (2006.01)

(52) U.S. Cl. ..... 417/397; 417/384

(58) Field of Classification Search ..... 417/375, 417/384, 397, 403, 404
See application file for complete search history.

(56) References Cited

U.S. PATENT DOCUMENTS 3,070,023 A * 12/1962 Glasgow ..... 417/397
3,143,075 A * 8/1964 Giroux et al. ..... 417/521
3,282,167 A * 11/1966 Mckenzie ..... 91/306
4,104,008 A * 8/1978 Hoffmann et al. ..... 417/397
4,350,266 A * 9/1982 Hetherington et al. ..... 222/40
4,382,750 A * 5/1983 Robertson et al. ..... 417/397
4,730,991 A * 3/1988 Handfield ..... 417/397
4,761,118 A * 8/1988 Zanarini ..... 417/254
5,094,596 A * 3/1992 Erwin et al. ..... 417/397
5,388,725 A * 2/1995 Lichfield ..... 222/1
7,284,543 B2 * 10/2007 Kato et al. ..... 123/527

* cited by examiner

*Primary Examiner* — Devon C Kramer
*Assistant Examiner* — Peter J Bertheaud
(74) *Attorney, Agent, or Firm* — Harrison Law Office, P.C.

(57) ABSTRACT

Motorized single-machine multi-pump apparatus and closed-loop methodology interconnected with a gas pipeline at a natural gas production well, using pressurized gas flow and differential pressure to drive a pumping system regulated by pneumatic controls using self-generated clean, low-pressure instrument air. The apparatus is connected to the gas flow line and the outlet is connected back into the gas flow line at lower pressure, creating a differential pressure corresponding to the source of motive power for actuating a piston which is directly connected to a plurality of plungers. This plurality of plungers is alternately pushed into and pulled out of corresponding plunger-cylinders for creating an integral drive and pump system prerequisite for gas well site pumping operations. Instead of venting to the atmosphere, well gas is returned to the flow line whereupon only clean air from the self-generated instrument air circuit is vented into the atmosphere.

14 Claims, 2 Drawing Sheets

PNEUMATIC MOTORIZED MULTI-PUMP SYSTEM

RELATED APPLICATIONS

This application claims priority based upon U.S. application Ser. No. 11/449,293 filed Jun. 8, 2006, which claimed priority based upon Provisional U.S. Application Ser. No. 60/015,744 filed Jun. 8, 2005.

FIELD OF THE INVENTION

The present invention relates to pumping systems, and more particularly, relates to an apparatus and methodology that incorporates multiple process pumps and a ventless gas drive mechanism into one machine that is controlled by pneumatic valves and switches using a self-generated supply of clean low pressure air.

BACKGROUND OF THE INVENTION

At natural gas production well sites and at other natural gas production facilities there is a requirement for process pumps to perform various applications. One application is to inject chemical into the well bore. A common example of this application is the injection of methanol into a well bore to inhibit the formation of hydrates. Another common example is the injection of a corrosion inhibitor. Still another application, specific to colder climates, is the pumping of hot glycol in order to circulate it through heat exchanger tubes contained within a process loop, thereby preventing freezing of the wellhead, water storage tanks, gas-liquid separator, flow lines and other related equipment and ancillary apparatus.

Since many natural gas production wells and their associated facilities are located in remote areas where electricity is typically unavailable, gas-driven pumps frequently are invoked to use well gas to drive pumping operations of various material flows. The well gas pressure in such common applications typically ranges from about 200 psi to about 1000 psi. Inasmuch as these gas-driven pumps require relatively low-pressure gas, typically ranging from about 30 psi to about 50 psi, in order to operate, the well gas pressure is first reduced by passing through a pressure regulator prior to being invoked to drive the pumping operations. Since this low-pressure gas cannot be returned to the high-pressure gas flow line, this low-pressure gas is exhausted to the atmosphere, thereby causing pollution and simultaneously wasting valuable gas.

An alternative and preferable approach is to use a ventless gas drive to drive process pumps. Ventless gas drives known in the art use high-pressure well gas to actuate pumping operations and then return the actuating gas to the well flow line so that no well gas is exhausted to the atmosphere. Such existing ventless gas drive designs correspond to stand-alone drive apparatus that have a reciprocating piston rod drive member that can be connected to a plurality of external reciprocating process pumps. Such existing ventless gas drive apparatus consist of a dual-acting piston within a closed cylinder with a piston rod drive member on one or both sides thereof. One or more external reciprocating pumps may then be mechanically connected to the piston rod drive member(s).

However, as is well known in the art, there are inherent problems associated with using a ventless gas drive apparatus connected to external reciprocating pumps at remote, infrequently-attended natural gas well sites where the equipment must operate continuously, i.e., operate 24 hours per day, every day of the year. It is also not unusual for natural gas wells to be located in adverse and even in harsh environments. Unfortunately, commercially-available reciprocating pumps require frequent maintenance to enable ongoing operation. In particular, such reciprocating pumps require periodic packing adjustment and concomitant lubrication-service. Reciprocating pumps are notoriously prone to both packing and seal leakage, and, therefore, in order to accommodate continual operation in the field, reciprocating pumps must be augmented with elaborate leakage-drain systems. But, ironically, while being implemented to promote continual operation of gas-driven reciprocating pumps, such elaborate leakage-drain systems, per se, require constant monitoring and maintenance.

Experience has shown that these reciprocating pumps typically need to be withdrawn from service and refurbished at least once per year. The mechanical connection between the pump and the drive unit piston rod needs frequent monitoring to assure proper alignment and free movement. Since the drive unit piston rod slides in and out of the drive unit cylinder through a sealed opening, it must be monitored closely for wear and leakage because such apparatus is sealing high-pressure well gas inside the cylinder, thereby preventing high-pressure well gas from being exhausted into the atmosphere.

Another limiting issue of ventless drive apparatus known to practitioners in the art is that the drive unit has a predefined stroke-length. This tends to limit the pumping range available from a driven external reciprocating pump which normally has a variable stroke-length. Furthermore, even though this pumping application often requires two different external pumps, e.g., an external methanol pump and an external glycol pump, and since it is not uncommon for each such external pump to have a different stroke-length and different pumping characteristics, each external pump must be directly connected to the drive apparatus piston rod having its own—usually different—stroke-length; and both external pumps must be driven at the same speed, i.e., strokes per minute, as the ventless drive. It should be evident that this situation complicates coordination of simultaneous operation of the two external pumps. For instance, for the instant exemplary field application, it is difficult for an operator to optimally set the pumping requirements simultaneously for both external pumps. This daunting challenge may compel an operator to run the external pumps at suboptimal settings.

It should be apparent that these maintenance and design issues tend to severely militate against practical application of such pumping systems at remote well sites that are only rarely scheduled to be serviced by operating personnel and that are dispersed over a wide geographical area, often in adverse and even harsh environments. As is common knowledge in the art, there are often hundreds of wells in a gas field, with frequent maintenance being neither practicable nor affordable. Moreover, in view of contemporary environmental regulations, pumping operations which are characterized by chronic seal and packing leakage problems—resulting in emissions of contaminants, including well gas, glycol, methanol, corrosion inhibitor, etc., into the environment is unacceptable and may be unlawful.

Representative of the prior art, in U.S. Pat. No. 6,694,858 and in U.S. Pat. No. 7,284,475, Grimes and Paval, respectively, disclose gas-driven reciprocating drive units, i.e., ventless gas drive units, that use a double-acting piston within a closed cylinder, in conjunction with a pressurized gas system such as a gas pipeline. A switching valve directs gas from areas of higher and lower pressure to opposite sides of the piston. The pressure differential between the two ends of the double-acting piston causes the piston to move toward a first end of the cylinder, simultaneously exhausting the gas in the first end of the cylinder back into the pressurized gas system. At or near the end of each piston stroke, the switching valve reverses the connections to the areas of higher and lower pressure in the pressurized gas system, thus inducing a pressure differential that causes the piston to move in the direction opposite to the previous stroke and thereby exhausting the gas in the second end of the cylinder back into the pressurized gas system. A piston rod connected to the piston is used to transfer the power generated by the movement of the piston to a pump or other ancillary equipment.

One of the significant drawbacks and disadvantages of the prior art exemplified by Paval and Grimes is that such embodiments of ventless gas drive apparatus are stand-alone drive units interconnected with external reciprocating pumps via a piston rod. Accordingly, embodiments of this art are susceptible to the hereinbefore elucidated operational problems and limitations. By contrast, embodiments of the present invention correspond to a pneumatic motorized multi-pump apparatus and concomitant methodology that inherently solves these problems and overcomes these limitations. As will be hereinafter described in detail, unlike the prior art, the instant pneumatic motorized multi-pump system requires neither packing nor seals that can leak pumped fluids into the environment; is devoid of a piston rod sliding in and out of a sealed opening that can leak well gas into the environment; is devoid of mechanical connections to external pumps; and requires no lubrication service.

Another significant drawback and disadvantage of the Paval and Grimes ventless gas drive units is that both prior art pump systems invoke spaced-apart circumferential piston seals to prevent flow of gas between the two ends of the drive cylinder. On the Grimes drive unit, as described by Paval, the ambient pressure within the annular space between the seals is constant and typically atmospheric at approximately 15 psi. By contrast, the gas pressure within each end of the drive cylinder may be about 1,000 psi. As a result, both of the seals in the Grimes unit are continuously working against a very large pressure differential, notwithstanding that the piston itself is exposed to only a small pressure differential. The high differential pressure acting across the seals causes high frictional forces which, in turn, reduces available power output from the drive and induces faster seal wear than if the pressure differential were significantly lower. Paval has overcome this problem via a differential shuttle valve system contained within the piston body, wherein the pressure in the annular space between the seals is always equalized to the pressure in the lower pressure end of the cylinder. It will be appreciated that this effects a differential pressure across the seals which is always equal to the pressure differential between the low pressure end of the cylinder and the high pressure end thereof. This differential pressure may be on the order of 10 to 20 psi. However, the differential shuttle valve system contained within the piston of the Paval drive introduces considerable complexity to the piston assembly which ramifies not only as higher cost, but also as more recurring maintenance.

As is well known in the industry, raw well gas often carries with it extraneous liquids such as water, condensate, etc., and extraneous solids such as sand, paraffin, pipeline debris, etc. Often the pumping system is located downstream from a gas-liquid separator apparatus and/or filter apparatus, but commonly extraneous liquids and extraneous fine solids still survive passage through these separating and filtering devices, thereby flowing throughout the pumping system. The small apertures and small passageways and moving parts of the prior art shuttle valve system are highly prone to becoming plugged and stuck under these conditions. Since the Paval shuttle valve system can be cleaned out and repaired only by taking the complete drive out of service, the Paval shuttle valve methodology therefore inflicts yet another level of maintenance concerns that militates against uninterrupted pumping operation at gas wells in the field.

As will be hereinafter described, the present invention—comprising a pneumatic motorized multi-pump apparatus and implicated systemic methodology—invokes a simpler, less costly sealing technology to maintain the differential pressure across the piston seal equal to the pressure differential between the low pressure end of the drive cylinder and the high pressure end of the drive cylinder, and it is not affected by the presence of either extraneous solids or extraneous liquids.

Yet another significant drawback and disadvantage of the Paval and Grimes ventless gas drives is the use of high pressure raw well gas to actuate the end-of-stroke switching and cycling control valves. As is well known by practitioners in the industry, raw well gas often carries with it extraneous liquids, e.g., water, condensate, etc., and extraneous solids, e.g., sand, paraffin, pipeline debris, etc. Often the pumping system will be located downstream from a gas-liquid separator and/or filter but, as is well known in the industry, some liquids and fine solids still often bypass these devices and therefore flow through the pumping system. The small apertures and small passageways and moving parts associated with the end-of-stroke switching and cycling control valves are highly prone to plugging up and sticking under these conditions. This prior art method of controlling the end-of-stroke switching and cycling of the drive unit therefore introduces still another maintenance issue to an already saturated, onerous maintenance scenario as hereinbefore described.

As will be described in detail, embodiments of the present invention, rely upon a pneumatic motorized multi-pump driver invoking a different low-maintenance methodology for controlling end-of-stroke switching and cycling of the drive unit. It will become clear that such embodiments are configured with a self-generated low pressure clean-air control circuit for actuating two low-pressure pneumatic end-of-stroke switching valves and a concomitant low-pressure pneumatic cycling valve. One of the integral pumps within the motorized multi-pump system is an air pump which supplies this low-pressure instrument air. It is a distinct advantage and feature of the present invention that this self-generated low-pressure air control circuit is completely isolated from the high-pressure raw well gas; and is inherently clean and not subject to the maintenance problems caused by intrusion of extraneous well liquids and extraneous well solids. As is well known in the industry, an additional advantage afforded by the use of a low-pressure clean-air control circuit is that low-pressure pneumatic valves, switches, and associated controls used in such a clean air instrument supply circuit have very high reliability ratings and protracted average run lives, e.g., run lives on the order of many millions of cycles.

Therefore, for the natural gas well pumping application elucidated herein, the prior art technology consists of two or more individual machines mechanically connected together, viz., a Paval-Grimes ventless gas drive unit interconnected with a plurality of driven external pumps. Such prior art pumping technology suffers from inherent operational and maintenance problems as hereinbefore described. Therefore, a need exists for a pumping apparatus and methodology that rely upon the ventless gas drive concept, but which can more adequately and more efficiently perform the demanding requirements of gas well pumping applications typically located in remote geographical venues. It will be hereinafter shown that embodiments of the present invention integrate multiple process pumps with a ventless gas drive mechanism to form a single machine satisfying the prerequisite pumping requirements of such gas well applications, thereby solving the persistent problems and overcoming the limitations that characterize such applications.

SUMMARY OF THE INVENTION

The pneumatic motorized multi-pump apparatus and methodology taught by the present invention constitutes a closed-loop pumping system that uses pressurized gas flow and differential pressure to drive the pumping system which is regulated by pneumatic controls that use a self-generated supply of clean, low-pressure instrument air. As will be appreciated by practitioners in the art, preferred embodiments may be interconnected with any gas pipeline. A typical embodiment would be interconnected with a gas flow line located in the vicinity of a natural gas production well.

More particularly, the inlet to an embodiment of the pneumatic motorized multi-pump apparatus of the present invention would be connected to an appropriate point in the gas flow line, and the outlet therefrom would be connected back into the gas flow line at a point of lower pressure than the inlet pressure. It will be understood that the instant methodology creates a differential pressure across this pumping system which corresponds to the source of motive power prerequisite for pumping operations contemplated hereunder. According to the present invention, the contemplated pumping operations inherently do not vent well gas to the atmosphere. Instead, well gas is returned to the flow line whereupon only clean air from the self-generated instrument air circuit is actually vented into the atmosphere.

As will hereinafter be described in detail, the pneumatic motorized multi-pump methodology taught herein is effectuated by well gas flow and differential pressure which synergistically function as the driving force for actuating a piston which is directly connected to a plurality of plungers. This plurality of plungers is alternately pushed into and pulled out of corresponding plunger-cylinders for creating an integral drive and pump system as taught herein. Unlike the prior art, embodiments of the instant pneumatic motorized multi-pump apparatus and methodology exhibit profound improvements that are manifest as a plethora of advantages especially significant due to the exigent maintenance-prone circumstances under which wellhead gas flows through downstream pipelines.

It will be seen that by applying such embodiments of the pumping system of the present invention at natural gas well pipelines, there are no seals that can leak pumped fluids into the environment; there are no external pumps that demand service and, likewise, there is no leaky pump packing that requires prompt maintenance and adjustments in the field. Accordingly, it will be appreciated that leakage drain systems are not required to perpetuate gas well pumping operations. Furthermore, there is no necessity for a piston rod to slide into and out of a sealed opening that tends to be a source of possible leakage of well gas into the environment.

It will also be seen that embodiments of the present invention are devoid of mechanical connections to external pumps that require alignment and maintenance; therefore, there are no exposed moving parts that can present safety hazards and, similarly, there are no connections exposed to the adverse affects caused by dust, rain, weather, and other exigent conditions. Inherently affording minimal maintenance, embodiments of the present invention require virtually no lubrication service.

Embodiments of the pneumatic motorized multi-pump systemic methodology of the present invention invoke simple, inexpensive sealing technology for routinely sustaining contemplated differential pressure across the drive piston seal. As will be hereinafter elucidated, differential pressure manifest across the drive piston seal would preferably be equal to the pressure differential between the low pressure end of the drive cylinder and the high pressure end thereof. Unlike particular developments in the art, embodiments of the present invention are devoid of complicated, maintenance-prone piston shuttle valves and the like.

It will be seen that the sealing technology invoked by embodiments of the present invention rely upon a proprietary O-ring energized Teflon composite ring seal which is inherently low friction due to not only its loose dimensional fit, but also due to its specially-selected self-lubricating material of construction. Advantageously, this material is chemically inert and is not subject to swelling; furthermore, this material has a self-cleaning wiper contour which is unaffected by extraneous solids or liquids contemplated herein.

Since, according to apparatus-configurations envisioned under the present invention, only low-pressure, clean-air comes into contact with the end-of-stroke switching and cycling controls, such apparatus is not subjected to the conventional harsh affects of exposure to raw high-pressure well gas typically containing both extraneous liquids and extraneous solids.

Furthermore, since embodiments of the instant pneumatic motorized multi-pump apparatus are not interconnected with external pumps, such embodiments do not need to be coordinated with the stroke lengths of external pumps; on the contrary, such embodiments have been independently designed and configured with relatively long stroke length and with relatively large diameter plungers. The consequent plurality of plungers and corresponding plurality of plunger-cylinders are disposed on opposite sides of the drive piston so that discharge pumping action would be manifest for all pumped fluids in both directions of the reciprocating pumping cycle. It will become evident to practitioners in the art that this phenomenon results in a high pumped volume per stroke-length, so that the pumping application requirements may be accomplished at relatively slower speeds, i.e., at relatively low strokes per minute, which has been found to significantly extend the longevity of seals and pneumatic controls.

Of course, this beneficial attribute is especially important for glycol pump applications which typically require 5 to 10 GPM (gallons per minute) as compared to chemical pump applications which typically require 5 to 50 GPD (gallons per day). It will be appreciated by practitioners in the art that existing pump technology under similar circumstances and conditions devolve to stand-alone drive units that are interconnected with external pumps, with one pump located on each end of the drive unit, and with each external pump therefore receiving discharge pumping action on only half of the reciprocating pumping cycle. In conjunction with the short stroke-lengths of these units, this means that such units must be operated at relatively high strokes per minute speeds, resulting in higher wear rates for seals, packing, controls and other pumping system components.

Another inherent advantage of embodiments of the instant pneumatic motorized multi-pump system is that there is only one seal between the well gas and the pumped fluids because the pumps are integrated into the drive piston, per se; accordingly, no seals are subjected to ambient pressure. Contrariwise, the prior art has two seals: one seal located where the drive unit piston rod passes through the end of the drive unit cylinder and the other seal located where the external pump driven rod passes through the body of the external pump. Therefore, prior art seals are subjected to larger differential pressures because ambient pressure of approximately 15 psi is being sealed.

It will be appreciated that the accumulation of prior art attributes accounts for added seal friction-induced power losses and renders the seals more susceptible to wear and deterioration. For pumping applications contemplated hereunder, there is limited well gas differential pressure available for operating the implemented pumping system. Minimizing seal friction-induced power losses tends to assure that low-maintenance, uninterrupted pump performance is realized. Accordingly, embodiments of the present invention efficiently transfer power from the energy source—well gas differential pressure between pumping apparatus inlet and pumping apparatus outlet—to the fluid(s) being pumped.

The pneumatic motorized multi-pump apparatus and associated methodology of the present invention supersede commonly used gas driven process pumps that exhaust significant amounts of well gas into the atmosphere as part of normal operational design and therefore not only waste valuable well gas, but also engender safety and pollution hazards. This type of application usually exists at well sites where there is no electrical power available. Even under circumstances in which electrical power is available, it may nevertheless be more economical to use the pneumatic motorized multi-pump system taught hereunder instead of electrical driven pumps since no electricity is required to run the instant multi-pumping system.

These advantages and objects of the present invention will become apparent from the following specifications and accompanying drawings, wherein like numerals refer to like components.

IN THE DRAWINGS

DETAILED DESCRIPTION

Figure 1:
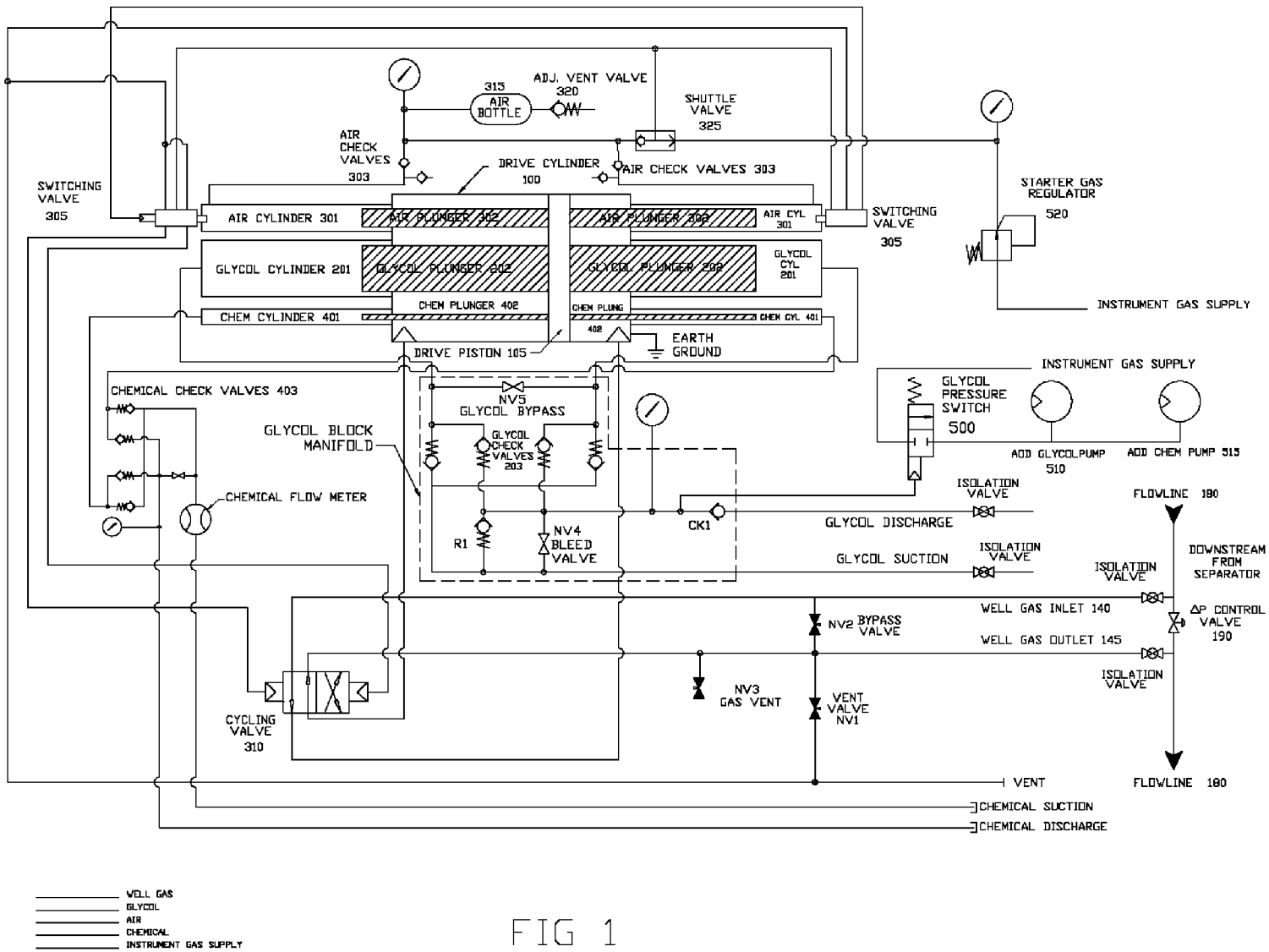
FIG. 1 depicts a simplified schematic diagram of the components and associated functionality of the preferred embodiment of the present invention.

As will become clear to those skilled in the art, preferred embodiments of the pneumatic motorized multi-pump system of the present invention are comprised of a drive cylinder having a drive piston and a plurality of interconnected plungers and corresponding plurality of plunger-cylinders. More particularly, each of a pair of plungers is interconnected on an opposite side of the drive piston. Each plunger, in turn, passes through a sealed opening in its respective end of the drive cylinder and then passes into a corresponding plunger-cylinder interconnected at its respective end of the drive cylinder. As the drive piston alternately moves back and forth under the influence of differential pressure as herein described, the drive piston pushes and pulls the plurality of plungers in and out of their corresponding plurality of plunger-cylinders, respectively, thereby generating the pumping cycles of the present invention.

As herein described, one pumping cycle consists of a discharge stroke and a suction stroke, respectively. During the discharge stroke, each of the plurality of plungers is pushed into its corresponding plunger-cylinder, thereby displacing liquid or gas from its plunger-cylinder. During the suction stroke, each plunger is pulled out of its corresponding plunger-cylinder, thereby sucking liquid or gas into its plunger-cylinder. Thus, the pumping cycles of the present invention devolve to a single machine having a series of plunger pumps that are integrated into a drive apparatus and functionally related to the movements of the drive apparatus as herein described.

According to the present invention, each of the plurality of integrated plunger pumps incorporates a conventional subassembly of four check valves to facilitate the suction and discharge of fluids as the plurality of plungers move back and forth as elucidated herein. Advantageously, preferred embodiments comprise a pneumatic motorized pump apparatus based upon formation of a single machine having an infrastructure comprised of a plurality of plunger pumps which are integrated into and inherently coupled with a pneumatic drive mechanism.

It will be appreciated that embodiments of these plunger pumps are dual-acting inasmuch as each pump is comprised of a pair of identical cylinders—one disposed on each end of the drive cylinder—and two plungers—one disposed on each side of the drive piston. It will be seen that embodiments of the present invention comprise a minimum of two plunger pumps: one functioning as a prime-mover of self-generated low-pressure instrument air supply and one functioning as a process pump. The typical gas well application herein elucidated requires incorporation of three plunger pumps: one air pump, one glycol pump, and one chemical pump. It should be evident that different gas well applications will require different numbers and sizes of plunger pumps.

The drive piston force available to drive the plurality of plunger pumps contemplated by the present invention may be calculated by the formula depicted in equation "1":

$$F=(P\times A)-\text{Friction} \quad (1)$$

where F=force generated by the drive piston; P=differential pressure; A=area of drive cylinder piston less plungers' cross-sectional area; and Friction=internal friction within the drive cylinder including piston seal friction.

It will also be understood that the location of the connection of each plunger to the drive piston is determined by a balance of forces calculation, wherein the net forces manifest on the drive piston are balanced across the drive piston's cross section and are uniformly perpendicular to the drive piston and parallel to the drive cylinder wall. Such equilibrium of the implicated forces assures that there is no bending moment on the drive piston and that, therefore, no unbalanced side-load forces are manifest on either the piston seal or the plunger seals. Of course, it will be appreciated that this configuration minimizes power losses attributable to seal friction which, in turn, minimizes seal wear rate and eliminates side-load forces as a possible cause of seal leakage.

The stroke length, piston diameter and plunger diameters are designed to yield optimum pressure and corresponding pumping rates for specific gas well pumping applications.

Figures 2A, 2B, 2C:
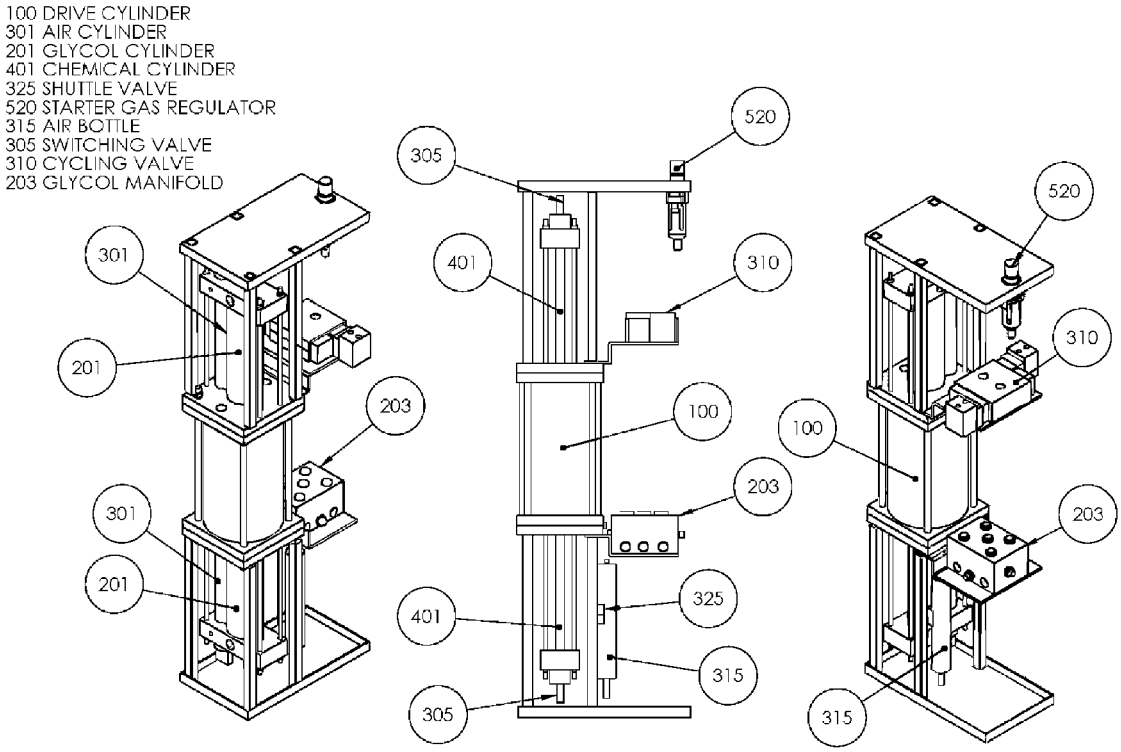
FIG. 2A depicts a rear perspective view of the preferred embodiment of the present invention depicted in FIG. 1.
FIG. 2B depicts a front view of the preferred embodiment of the present invention depicted in FIG. 2A.
FIG. 2C depicts a front perspective view of the preferred embodiment of the present invention depicted in FIGS. 2A and 2B.

Now focusing collectively on FIGS. 1, 2A, 2B, and 2C, there is depicted a typical natural gas production well application utilizing the preferred embodiment. The differential pressure prerequisite for operating the pumping operations contemplated hereunder is generated by a differential pressure control valve 190 which is connected to the flow line 180 disposed immediately downstream of a gas-liquid separator widely used in the art. Of course, it will be appreciated by those skilled in the art that differential pressurize control valve 190 may also be disposed in other positions relative to a separator or like apparatus, as suitable for the specific gas well installation.

Still referring collectively to FIGS. 1, 2A, 2B, and 2C, typical flow line pressures manifest in flow line 180 vary from about 200 to about 1000 psi or more. In particular, the differential pressure control valve 190 generates a pressure differential between the well gas inlet 140 and the well gas outlet 145 such that the well gas inlet pressure is higher than the well gas outlet pressure. For instance, in a typical gas well scenario, the differential pressure control valve 190 would be set to generate a differential pressure of about 15 psi and if, for purposes of illustration, the pressure at the well gas inlet 140 were about 415 psi, then the pressure at the well gas outlet 145 would be about 400 psi.

During the pumping operation of the present invention, the pneumatically-controlled cycling valve 310 supplies higher pressure inlet well gas first to one side of the dual acting drive cylinder 100, thereby pushing the drive cylinder piston 105 in one direction, while exhausting lower pressure well gas out of the other, opposite side of the drive cylinder 100 to the well gas outlet 145, and then back into the flow line 180. According to the present invention, when reaching the end of its stroke, the air plunger 302 mechanically actuates a pneumatic switching valve 305 which, in turn, actuates the cycling valve 310. In so doing, once cycling valve 310 is actuated, the higher pressure inlet well gas is switched to the other, opposite side of the drive cylinder 100, thereby pushing the drive cylinder piston 105 back in the opposite direction, while simultaneously exhausting lower pressure well gas out the other, opposite side of the drive cylinder 100 to the well gas outlet 145, and then back into the flow line 180. When reaching the other end of its stroke, the air plunger 302 mechanically actuates another pneumatic switching valve 305.

It should be evident that the instant pumping cycle continuously repeats itself in the same manner. Ergo, for the common gas well scenario contemplated herein, the pressure generated by the differential pressure control valve 190 may be varied from about 1 psi to a maximum of about 15 psi. The speed manifest as pumping rate, i.e., strokes per minute, may be readily and conveniently controlled by adjusting the differential pressure control valve 190. Accordingly, for embodiments of the present invention as herein described, increasing differential pressure proportionately increases the stroke speed of the drive piston 105.

It should be apparent to those conversant with the art, that the pneumatic motorized multi-pumping apparatus and concomitant methodology taught by the present invention does not rely upon high pressure raw well gas—which may contain extraneous liquids, foams, and solids—to actuate the pivotal end-of-stroke switching and concomitant cycling controls. Contrariwise, the instant pumping methodology is controlled through a plurality of low-pressure pneumatic valves and associated switches. Unlike the prior art, the pumping methodology described herein generates its own clean and low-pressure instrument air supply for actuating these pneumatic valves and associated switches.

One of the pumps integral to embodiments of the present invention comprises an air pump configured with a pair of preferably identical air cylinders 301, with an air cylinder disposed on each end of the drive cylinder 100, and a pair of preferably identical air plungers 302, with a plunger disposed on each side of the drive piston 105. It will be seen that this air pump supplies clean air to the air bottle 315. The pressure of air bottle 315 is regulated by an adjustable vent valve 320. At pneumatic pump start-up, a small amount of well gas obtained from the locally-available low-pressure instrument gas scrubber and/or filter is supplied to the instant control system through a gas regulator 520 and associated shuttle valve 325. It should be understood that this small amount of low-pressure instrument well gas is used to operate the switching valves 305 and cycling valve 310 with interconnecting hoses for a short induction period in order to begin the stroking of the drive piston 105 which, in turn, drives the plurality of air plungers 302 which consequently begin pumping air into the air bottle 315 as contemplated hereunder. For the instant natural gas well scenario, the adjustable vent valve 320 is set to maintain the air pressure in the air bottle 315 at about 10 to 15 psi, and the gas regulator 520 is set to supply instrument well gas at a threshold pressure of about 5 to 10 psi.

When the air supply in the air bottle 315 reaches a pressure slightly higher than the pressure of the instrument well gas coming from the gas regulator 520, observed to occur after approximately one drive piston stroke, the shuttle valve 325 then deactivates the instrument well gas from the gas regulator 520 and, in turn, activates the supply air from the air bottle 315. It will be understood by those skilled in the art that, in a typical application, one drive piston stroke has an average duration of approximately 10 seconds which essentially corresponds to approximately 50 cubic inches of gas (approximately 0.03 cubic feet). The control system of the present invention then continues to run the pumping system using only its self-generated clean, low-pressure air supply to actuate the switching valves 305 and associated cycling valve 310.

It should be evident to those skilled in the art that, for this exemplary well gas scenario, there are three integral dual acting plunger pumps comprising the pneumatic motorized multi-pump system taught herein: an air pump as hereinbefore described and two product-oriented material flow pumps—one glycol pump and one methanol chemical pump. The glycol pump is comprised of a pair of preferably identical glycol cylinders 201, with each glycol cylinder disposed on each end of the drive cylinder 100; and a pair of preferably identical glycol plungers 202, with each glycol plunger disposed on each side of the drive piston 105. The chemical pump is comprised of a pair of preferably identical chemical cylinders 401, with one chemical cylinder disposed on each end of the drive cylinder 100 and a pair of preferably identical chemical plungers 402, with each chemical plunger disposed on each side of the drive piston 105. It will be seen that, as the drive piston 105 strokes back and forth, it pushes and pulls these glycol plungers 202 and corresponding chemical plungers 402, in and out of their respective glycol cylinders 201 and chemical cylinders 401. This push-pull manifestation of the drive piston stroking engenders the pumping action prerequisite for supplying glycol and chemical at the entire gas well site which, of course, includes the circulation of glycol through a warming loop that constitutes the tanks, separator, and the well itself. It will be understood that each of these three dual acting plunger pumps incorporates a conventional subassembly of four check valves to facilitate the suction and discharge of fluids as their respective plungers intermittently move back and forth, with air check valves 303, glycol check valves 203 and chemical check valves 403 functioning as hereinbefore elucidated.

Now, those skilled in the art will appreciate that, if the gas flow from the gas well is interrupted, the differential pressure control valve 190 may be unable to generate a sufficient differential pressure between the well gas inlet 140 and the well gas outlet 145 in order to actuate the drive piston 105 as contemplated by the present invention. Similarly, such an interruption may additionally cause a reduction in well gas volume, thereby reducing the capacity of the instant pneumatic drive. An interruption in the gas flow from the well can be due to the well loading up with fluids, i.e., with water and/or condensate, to the well plugging up due to formation of hydrates, and/or to closing of a valve or to even other reasons that may arise.

The instant pneumatic motorized multi-pump methodology has an inherent backup protocol which provides for continued pumping of products, e.g., glycol and methanol—or other material flow—until the interruption of gas flow from the well can be corrected. This backup protocol comprises a glycol pressure switch 500 and one or more air-operated diaphragm pump(s) ("AOD" pump) 510 and 515. If the glycol pressure switch 500 detects a low glycol discharge pressure condition below a predetermined threshold, it will actuate the low-pressure AOD supply gas and the AOD pump(s) 510 and 515 will begin to pump the product(s) (such as glycol and methanol in this example). When normal gas flow from the well resumes, the pneumatic motorized multi-pump apparatus begins to generate adequate glycol discharge pressure whereupon the glycol pressure switch 500 deactivates the low-pressure AOD supply gas to the AOD pump(s) 510 and 515, and then the pneumatic motorized multi-pump apparatus resumes normal operation.

Other variations and modifications will, of course, become apparent from a consideration of the apparatus and concomitant methodology hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. A motorized single-machine multi-pump system interconnected with a flowline having well gas flowing therethrough, having a plurality of process pumps and a ventless drive mechanism for circulating a corresponding plurality of fluids throughout a gas well production facility regulated by pneumatic controls using self-generated and self-regulated clean, low-pressure instrument air, said motorized multi-pump system comprising:

a differential pressure control valve member connected into said flowline to generate a pressure differential between an inlet member and an outlet member, with said well gas flow through said inlet member flowing at higher pressure than said well gas flow at said outlet member;

a piston drive member disposed within a drive cylinder member, said piston drive member having a pair of air-plunger members, each air-plunger member being disposed on an opposite side thereof, with each of said pair of air-plunger members disposed within a corresponding pair of air-plunger-cylinder members;

said piston drive member further including a plurality of additional pairs of plunger members, the plunger members of each said additional pair also being disposed on opposite sides of said piston drive member, and wherein the plunger members of each said additional pair are disposed within corresponding additional pairs of plunger-cylinder members;

each air-plunger-cylinder member of said pair of air-plunger-cylinder members and each plunger-cylinder member of said additional pairs of plunger-cylinder members being connected to opposite ends of said drive cylinder member, and each said air-plunger member and each said plunger member passing through a sealed opening in the respective proximal end of said drive cylinder member and then passing into the corresponding air-plunger-cylinder member and plunger-cylinder member, respectively;

wherein said self-generated low-pressure clean air is supplied from an interconnected air bottle for actuating each of a pair of end-of-stroke switching valve members, disposed at a distal end of each of said air-plunger-cylinder members, when said drive piston reaches the end of its stroke, and wherein said self-generated low-pressure clean air then actuates a cycling valve member for continuously directing said well gas at high pressure alternately to each end of said drive cylinder member and for simultaneously directing said well gas at low pressure alternatively to the opposing each end of said drive cylinder member, while returning said low-pressure well gas to said flowline through said outlet member without any venting of said low-pressure well gas into the atmosphere.

2. The motorized single-machine multi-pump system recited in claim 1, wherein said drive cylinder member comprises a cylindrical surface member and a pair of opposing end members disposed perpendicular thereto and continuous therewith.

3. The motorized single-machine multi-pump system recited in claim 1, wherein said piston drive member further comprises a disc member having an outer diameter dimensionally similar to said cylindrical surface member and a ring seal member annularly and medially disposed along the circumference of said disc member, said ring seal member bifurcating said drive cylinder member.

4. The motorized single-machine multi-pump system recited in claim 3, wherein one of said air-plunger members and one plunger member of each said additional pair of said plunger members are perpendicularly disposed on either side of said disc member with opposing forces balanced thereon.

5. The motorized single-machine multi-pump system recited in claim 2, wherein each of said pair of opposing end members contains a plurality of apertures, each of which are dimensionally similar to corresponding ends of each air-plunger-cylinder member and each plunger-cylinder member interconnected thereto.

6. The motorized single-machine multi-pump system recited in claim 1, wherein each air-plunger-cylinder member further comprises a cylindrical surface member and an end member which is perpendicular to said cylindrical surface member and continuous therewith, said cylindrical surface member having an inner diameter functionally related to the volume of air contained therein and displaced by movement of said piston drive member.

7. The motorized single-machine multi-pump system recited in claim 6, wherein a pair of check valves is disposed external of and proximal to said end member of each air-plunger-cylinder member.

8. The motorized single-machine multi-pump system recited in claim 7, wherein one of said pair of check valves enables airflow into said air-plunger-cylinder member, and wherein the other of said pair of check valves enables airflow out of said air-plunger-cylinder members.

9. The motorized single-machine multi-pump system recited in claim 1, wherein each plunger-cylinder member further comprises a cylindrical surface member and an end member which is perpendicular to said cylindrical surface member and continuous therewith, said cylindrical surface member having an inner diameter functionally related to the volume of material contained therein and displaced by movement of said piston drive member.

10. The motorized single-machine multi-pump system recited in claim 9, wherein a pair of check valves is disposed external of and proximal to said end member of each plunger-cylinder member.

11. The motorized single-machine multi-pump system recited in claim 10, wherein one of said pair of check valves enables material flow into said plunger-cylinder member, and wherein the other of said pair of check valves enables material flow out of said plunger-cylinder members.

12. The motorized single-machine multi-pump system recited in claim 1, wherein said cycling valve member and said pair of end-of-stroke switching valve members are simultaneously interconnected with a shuttle valve member which is, in turn, interconnected with a gas regulator member, said shuttle valve member discharging low-pressure instrument gas for pneumatic startup of said motorized single-machine multi-pump system, thereby actuating said cycling valve member and said pair of end-of-stroke switching valve members when said air bottle has an internal pressure less than a predetermined threshold pressure.

13. The motorized single-machine multi-pump system recited in claim 12, wherein said predetermined threshold pressure is about 10 psi.

14. The motorized single-machine multi-pump system recited in claim 1, wherein a pressure switch is simultaneously hydraulically interconnected with one of said plunger-cylinder members and a plurality of low-pressure gas supply lines which, in turn, are each connected to each of a corresponding plurality of backup air-operated diaphragm pumps, with said pressure switch activating respective material flow through said plurality of backup air-operated diaphragm pumps when said pressure switch has a pressure less than a predetermine threshold pressure.

* * * * *